US006422429B2

(12) United States Patent
Garcia et al.

(10) Patent No.: US 6,422,429 B2
(45) Date of Patent: Jul. 23, 2002

(54) FLUID-DISPENSING MEMBER HAVING AN OFF-CENTER DELIVERY CHANNEL

(75) Inventors: Firmin Garcia, Evreux; Stéphane Beranger, Le Neubourg, both of (FR)

(73) Assignee: Valois, S.A., Le Neubourg (FR)

( * ) Notice: Subject to any disclaimer, the term of this patent is extended or adjusted under 35 U.S.C. 154(b) by 0 days.

(21) Appl. No.: 09/810,647

(22) Filed: Mar. 16, 2001

(30) Foreign Application Priority Data

Mar. 20, 2000 (FR) ..... 00 03532

(51) Int. Cl.[7] ..... B67D 5/40
(52) U.S. Cl. ..... 222/385
(58) Field of Search ..... 222/385, 380

(56) References Cited

U.S. PATENT DOCUMENTS 6,186,371 B1 * 2/2001 De Pous et al. ..... 222/385

FOREIGN PATENT DOCUMENTS

FR 2714027 * 6/1995

* cited by examiner

*Primary Examiner*—Philippe Derakshani
(74) *Attorney, Agent, or Firm*—Wood, Philips, Katz, Clark & Mortimer

(57) ABSTRACT

A fluid-dispensing member is designed to be mounted on the neck of a container. The dispensing member includes: a body defining a chamber that slidably receives a piston; a fixing member designed to co-operate with the neck and extending around the body; and a delivery channel connecting the chamber to a stationary dispensing orifice. The delivery channel is formed between the body and the fixing member. The fixing member is suitable for co-operating with an inside wall of the neck so as to fix the dispensing member in the neck.

10 Claims, 1 Drawing Sheet

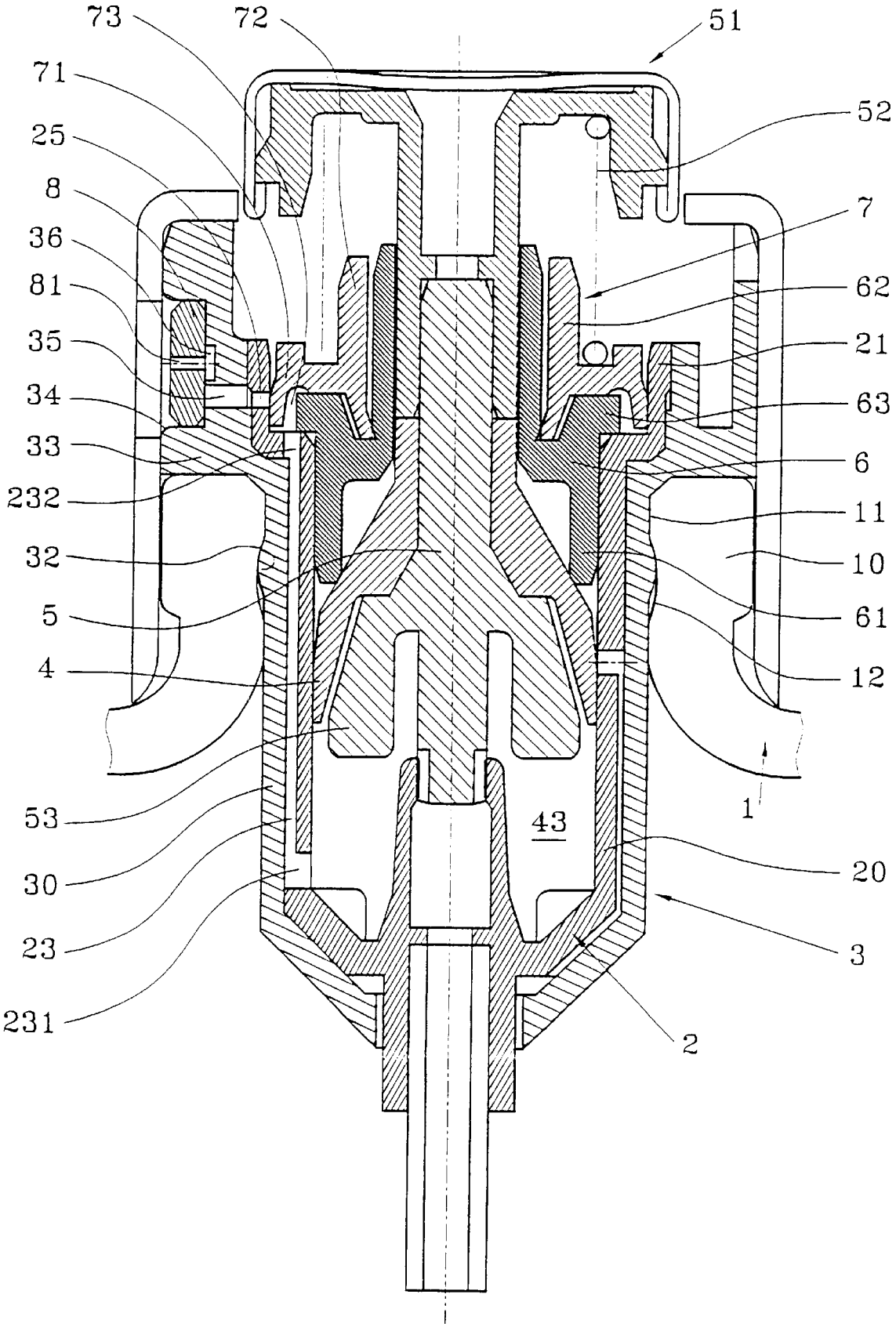
73
72
51
71
52
25
8
7
36
62
81
21
35
63
34
6
33
11
232
10
32
61
5
12
4
1
53
43
20
30
3
23
231
2

FLUID-DISPENSING MEMBER HAVING AN OFF-CENTER DELIVERY CHANNEL

The present invention relates to a dispensing member for dispensing a fluid, which dispensing member is designed to be mounted on the neck of a container. In general, this type of dispensing member comprises a body defining a chamber inside which a piston is mounted to slide. In addition, a fixing member is often provided for fixing the dispensing member to the neck of the container. To convey the fluid from the chamber to a dispensing orifice, a delivery channel is often provided. A feature of the dispensing member of the present invention is that the dispensing member is stationary.

BACKGROUND OF THE INVENTION

Document WO 93/03857 describes a fluid-dispensing member having a stationary dispensing orifice. That prior art dispensing member comprises a body in which a cylindrical piece is engaged that co-operates with a piston to define the pump chamber. In other words, the piston, as provided with a pusher on its top, is mounted to slide inside said cylindrical piece which is received inside the body of the dispensing member. At its bottom end, the cylindrical piece defines an outlet valve seat. The body is further provided with a fixing member in the form of a snap-fastening ring designed to co-operates with the outside of the neck of a container. To hold that dispensing member on the neck, a capping piece is provided that defines an end-piece at the end of which a stationary dispensing orifice is situated. More precisely, the capping piece is screwed onto the body, thereby holding the fixing member on the body. To connect the chamber to the dispensing orifice, a delivery channel is provided that extends between the cylindrical piece and the body. The delivery channel extends from the bottom end of the cylindrical piece to its top end in vertical manner when the dispensing member is upright. To this end, a groove is formed in the inside wall of the body, and said groove is isolated in leaktight manner by the cylindrical piece mounted inside the body.

It should also be noted that that dispensing member is made up of four parts (excluding the piston), namely a body, a cylindrical piece, a fixing member, and a capping piece.

Document FR 2 714 027 discloses a manually-operated pump comprising an internal cylinder in which a piston is slidably mounted and a body in which the cylinder is received. The outside diameter of the cylinder is considerably smaller than the inside diameter of the body, so that a space is defined between the cylinder and the body. The space has a cross-section that is crescent-shaped because the cylinder is positioned in off-center manner in the body. The crescent-shaped space defines a considerable volume which is dead volume. In addition, the body is extended upwards to form a fixing ring for fixing to the outside of the neck of a container. It can be said that the body of that pump is made up of two distinct portions, namely a skirt receiving the cylinder and a ring coming around a neck, even though the skirt and the ring are connected together to form a one-piece unit. It should be noted that, by fixing onto the outside of the neck, the ring also increases the working diameter of the pump.

OBJECTS AND SUMMARY OF THE INVENTION

An object of the present invention is to remedy the above-mentioned drawbacks of the prior art by defining a dispensing member that has as small a number of component parts as possible, while defining a delivery channel that is off-center, whose dead volume is small, and that leads to a stationary dispensing orifice.

To this end, the present invention provides a fluid-dispensing member designed to be mounted on the neck of a container, said dispensing member comprising:

a body defining a chamber that slidably receives a piston;

a fixing member designed to co-operate with the neck, said fixing member extending around the body; and a delivery channel connecting the chamber to a stationary dispensing orifice, said delivery channel being formed between the body and the fixing member;

wherein the fixing member is suitable for cooperating with an inside wall of the neck so as to fix the dispensing member in the neck.

The fixing member thus serves both to form the delivery channel and to fix the dispensing member in the neck.

Advantageously, the fixing member is provided with snap-fastening means serving to co-operate with at least one notch formed in the inside wall of the neck.

In an embodiment, the fixing member is provided with a substantially cylindrical skirt internally co-operating with the body to define the delivery channel, and externally defining snap-fastening means for snap-fastening in the neck. The skirt thus also performs two functions by itself.

Advantageously, said delivery channel forms a groove in the outside wall of the body, said fixing member being provided with a skirt that is in contact with the body. The skirt is in tight-fitting contact with the body so that the groove provided in the outside wall of the body is isolated over its entire length. Preferably, the channel extends substantially over the entire height of the body.

In a practical embodiment, the body is engaged to slide snugly in leaktight manner in the skirt of the fixing member.

Advantageously, the snap-fastening means comprise at least one projection serving to snap-fasten into the notch in the neck.

The fixing member, which is then almost invisible, then performs two functions, namely the function of isolating the groove by means of its inside wall, and the function of fixing by snap-fastening by means of its outside wall. The fixing member can then basically be in the form of a skirt encasing the body of the dispensing member.

According to another characteristic of the invention, the delivery channel opens out in the vicinity of the stationary dispensing orifice. The path over which the fluid flows is thus reduced to as short as possible, thereby reducing head loss and easing dispenser operation.

In an embodiment, the dispensing orifice is formed in the fixing member or in a nozzle received in a recess formed in the fixing member.

BRIEF DESCRIPTION OF THE DRAWING

The invention is described more fully below with reference to the sole drawing which shows an embodiment of the present invention by way of non-limiting example.

The sole FIGURE is a vertical cross-section through a dispensing member of the invention as mounted on the neck of a container.

MORE DETAILED DESCRIPTION

In conventional manner, the dispensing member shown in the sole FIGURE is a pump comprising a pump body 2 defining a barrel inside which a piston 4 is slidably received that is mounted on the end of an actuating rod 5 equipped at its top end with a pusher 51. The pump body 2 co-operates with the piston 4 to define a pump chamber 43 of variable volume and having an outlet 231, and an inlet 230 communicating with the inside of a reservoir. A return spring 52 returns the piston 4 to its rest position in which the volume of the pump chamber 43 is at its maximum. To limit the stroke of the piston and to set its top dead center corresponding to its rest position, a ferrule 6 is provided that is engaged by force into the pump body 2 at the top end thereof.

This is a quite conventional design for a fluid pump, as can be encountered in the fields of perfumes, of cosmetics, and of pharmaceuticals.

To fix the dispensing member to the neck 10 of a container 1, a fixing member 3 is provided in the form of a fixing ring that co-operates with the neck 10. In general, that type of fixing ring co-operates with the outside wall of the neck 10 which forms a reinforcing rim. Although that technique of fixing the dispensing member to the outside of the neck is also applicable in the present invention, a fixing ring that co-operates with the inside wall 11 of the neck 10 is preferred. To this end, the inside wall 11 of the neck 10 is provided with at least one notch 12 and the fixing ring 3 is provided with a skirt 30 whose outside wall is provided with at least one projection 32 serving to snap-fasten inside the notch 12. At its top end, the skirt 30 forms a shoulder 33 serving to come into abutment against the top end of the neck 10. The shoulder 33 comes into contact with the neck 10 when the projection 32 is snap-fastened in the notch 12. In this embodiment, the fixing ring 3 forms a recess 34 in which a spray nozzle 8 is mounted that forms a stationary dispensing orifice 81. In a variant, this orifice may also be formed directly in the fixing ring 3. In addition, the ring forms an outlet channel 35, and a swirl chamber 36 and channels 35. A trim band 9 may also come to cover the fixing ring so as to hide it and the neck 10.

The body 2 of the pump is engaged into the skirt 30 of the ring 3. The outlet of the pump chamber 43 is formed in the pump body 2 and it is connected to the nozzle 8 via a delivery channel 23. The delivery channel 23 is formed between the body 2 and the fixing ring 3, in particular its skirt 30. More precisely, the outside wall of the body 2 is provided with a groove which extends from the outlet 231 to another bore 232 formed through the wall of the pump body. Since the body 2 is engaged by force inside the skirt 30, the skirt 30 completes the groove provided in the body of the pump so as to isolate and thus form the delivery channel 23. At the outlet of the bore 232, the fluid arrives in a chamber 73 of variable volume. An outlet valve is implemented in the form of a differential piston 7 which is mounted to slide on the ferrule 6 and which is resiliently urged by the spring 52 which thus serves both as a return spring and as a pre-compression spring. Thus, when the pressure inside the chamber 43 is high enough, the differential piston 7 moves upwards and uncovers another bore 25 that is provided in the body 20 and that communicates with the outlet duct 35 formed by the fixing ring 3. This is a particular construction of the dispensing member that may naturally undergo numerous modifications without going beyond the spirit of the invention, which spirit lies in the fact that the delivery channel 23 is formed between the pump body 20 and the fixing member, i.e., in this example, the skirt 30 of the ring 3. It is also advantageous for the fixing member to co-operate with the inside wall of the neck so that the same part, namely the skirt 30, performs two functions by means of its inside and outside walls.

What is claimed is:

1. A fluid-dispensing member designed to be mounted on the neck of a container wherein said neck has an inside wall, said dispensing member comprising:

a body defining a chamber that slidably receives a piston;

a fixing member designed to co-operate with the neck, said fixing member extending around the body; and a delivery channel connecting the chamber to a stationary dispensing orifice, said delivery channel being formed between the body and the fixing member;

wherein the fixing member has an outside wall suitable for co-operating with said inside wall of the neck so as to fix the dispensing member in the neck.

2. A dispensing member according to claim 1, in which the fixing member outside wall is provided with snap-fastening means serving to co-operate with at least one notch formed in the inside wall of the neck.

3. A dispensing member according to claim 1, in which the fixing member is provided with a substantially cylindrical skirt internally co-operating with the body to define the delivery channel, and externally defining said outside wall which has snap-fastening means for snap-fastening in the neck.

4. A dispensing member according to claim 1, in which said body has an outside wall and in which said delivery channel forms a groove in the outside wall of the body.

5. A dispensing member according to claim 1, in which the channel extends substantially over the entire height of the body.

6. A dispensing member according to claim 1, in which said fixing member includes a substantially cylindrical skirt in which the body is engaged to slide snugly in leaktight manner in the skirt of the fixing member.

7. A dispensing member according to claim 1, in which the delivery channel opens out in the vicinity of the stationary dispensing orifice.

8. A dispensing member according to claim 1, in which the dispensing orifice is formed in the fixing member.

9. A dispensing member according to claim 1, in which the dispensing orifice is formed by a nozzle mounted in a recess formed in the fixing member.

10. A dispensing member according to claim 2, in which the snap-fastening means comprise at lease one projection serving to snap-fasten into the notch in the neck.

* * * * *